US010011141B2

(12) United States Patent
Rosset

(10) Patent No.: US 10,011,141 B2
(45) Date of Patent: Jul. 3, 2018

(54) SECURITY STRUCTURE INCLUDING PHOSPHORESCENT AND FLUORESCENT COMPOSITIONS

(76) Inventor: Henri Rosset, Le Pin (FR)

( * ) Notice: Subject to any disclaimer, the term of this patent is extended or adjusted under 35 U.S.C. 154(b) by 948 days.

(21) Appl. No.: 13/813,103

(22) PCT Filed: Jul. 26, 2011

(86) PCT No.: PCT/IB2011/053323
§ 371 (c)(1),
(2), (4) Date: Feb. 15, 2013

(87) PCT Pub. No.: WO2012/014151
PCT Pub. Date: Feb. 2, 2012

(65) Prior Publication Data
US 2013/0147181 A1 Jun. 13, 2013

(30) Foreign Application Priority Data
Jul. 29, 2010 (FR) ..... 10 56284

(51) Int. Cl.
*B42D 25/00* (2014.01)
*B42D 25/387* (2014.01)
(Continued)

(52) U.S. Cl.
CPC ..... *B42D 25/29* (2014.10); *B42D 25/00* (2014.10); *B42D 25/387* (2014.10); *D21H 21/40* (2013.01);
(Continued)

(58) Field of Classification Search
CPC ..... B42D 25/387
(Continued)

(56) References Cited

U.S. PATENT DOCUMENTS 4,897,300 A * 1/1990 Boehm ..... G07D 7/12 283/85
6,036,232 A * 3/2000 Kaule ..... B42D 25/29 283/85
(Continued)

FOREIGN PATENT DOCUMENTS

| | | | |
|---|---|---|---|
| EP | 0 303 725 | 2/1989 | |
| EP | 2 028 017 | 2/2009 | |
| GB | 2 258 426 | 2/1993 | |
| WO | WO 9840223 A1 * | 9/1998 | ..... B42D 25/00 |

OTHER PUBLICATIONS

English Translation of International Search Report and Written Opinion issued in International Application No. PCT/IB2011/053323 dated Nov. 29, 2011, 21 Pages.

*Primary Examiner* — Kyle Grabowski
(74) *Attorney, Agent, or Firm* — MH2 Technology Law Group, LLP

(57) ABSTRACT

The present invention relates to a security structure (10), comprising at least one first fluorescent composition (13) and at least one second phosphorescent composition (12), the first and second compositions being simultaneously excitable by a predefined illuminant from a single first surface (14) of the structure, the security structure (10) being provided in the form of a security thread, a security film, or a patch, wherein the first fluorescent composition is at least partially stacked on the second phosphorescent composition and/or the first and second compositions are used for the reference marking on the security structure.

22 Claims, 4 Drawing Sheets

Figure 1:
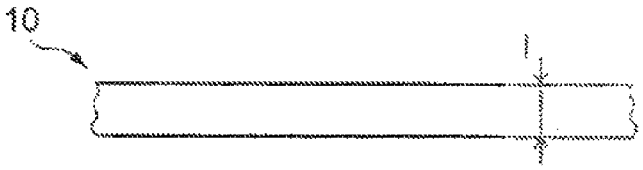

(51) Int. Cl.

| | |
|---|---|
| ***B42D 25/29*** | (2014.01) |
| ***D21H 21/40*** | (2006.01) |
| ***D21H 21/42*** | (2006.01) |
| ***D21H 21/48*** | (2006.01) |
| ***G07D 7/1205*** | (2016.01) |

(52) U.S. Cl.
CPC ..... *D21H 21/42* (2013.01); *D21H 21/48* (2013.01); *G07D 7/1205* (2017.05); *Y10T 428/24331* (2015.01); *Y10T 428/24802* (2015.01); *Y10T 428/24851* (2015.01); *Y10T 428/2933* (2015.01); *Y10T 428/2935* (2015.01)

(58) Field of Classification Search
USPC ..... 283/93
See application file for complete search history.

(56) References Cited

U.S. PATENT DOCUMENTS

| | | | | |
|---|---|---|---|---|
| 2002/0160188 | A1 | 10/2002 | Tam et al. | |
| 2002/0172807 | A1* | 11/2002 | Ridyard ..... | B42D 25/29 428/195.1 |
| 2006/0014045 | A1 | 1/2006 | Einhorn et al. | |
| 2006/0249951 | A1* | 11/2006 | Cruikshank ..... | B42D 25/29 283/92 |
| 2009/0008458 | A1 | 1/2009 | Vast et al. | |
| 2009/0188638 | A1 | 7/2009 | Chalaye et al. | |
| 2010/0194093 | A1* | 8/2010 | Macpherson ..... | B42D 25/355 283/94 |

* cited by examiner

SECURITY STRUCTURE INCLUDING PHOSPHORESCENT AND FLUORESCENT COMPOSITIONS

CROSS-REFERENCE TO RELATED APPLICATIONS

This application is a U.S. National Stage application of PCT/IB2011/053323, filed Jul. 26, 2011, which claims priority to French patent application 10/56,284, filed Jul. 29, 2010, the disclosures of which are hereby incorporated herein by reference in their entireties.

The present invention relates to security structures intended for combating the counterfeiting of identity documents or documents of value.

The invention relates more particularly to les security structures comprising luminescent substances. The expression "luminescent substance" should be understood to mean a fluorescent or phosphorescent substance.

Various security structures incorporating luminescent substances are known.

Thus, application FR 2 877 609 discloses a security thread comprising first and second fluorescents zones that emit lights of different colors.

Application FR 2 866 036 discloses a flat security element that may incorporate a fluorescent or phosphorescent substance.

Application EP 2 028 017 discloses a security structure comprising two apertured opaque layers, a first fluorescent layer being located between the first and second apertured opaque layers and a second fluorescent layer being located so as to be separated from the first fluorescent layer by one of the apertured opaque layers.

Application US 2002/0160188 describes a security fiber comprising juxtaposed luminescent components, capable of emitting, next to one another, a blue fluorescence and a red fluorescence.

Application US 2006/0014045 describes the possibility of applying a mixture of a fluorescent substance and of a phosphorescent substance to a polymer layer of a security film.

There is a need to further improve the security structures incorporating luminescent substances, in particular in order to create novel effects for the purpose of making them more attractive for the observer, while being difficult to counterfeit and offering a security that can be observed with the naked eye or under low magnification and under appropriate lighting.

One subject of the invention is thus, according to one of its aspects, a security structure comprising:

at least one first fluorescent composition, at least one second phosphorescent composition, the first and second compositions being able to be excited simultaneously by a predefined illuminant from one and the same first face of the structure.

The predefined illuminant is a UV or IR illuminant, preferably a UV illuminant at 365 nm.

Owing to the invention, when the first and second compositions are excited by said illuminant, the lights emitted by fluorescence and phosphorescence may be combined or be juxtaposed depending on the configurations of the security structure, and may produce an optical effect which is different from that which can be observed after extinguishing the illuminant, where only the light emitted by phosphorescence is capable of being perceived by the observer.

The structure may be arranged so that the excitation of the compositions and the observation of the luminescence can only be carried out from a single face of the structure.

As a variant, the structure may be arranged so that the excitation and the observation can be carried out from each of the faces of the structure.

The first and second compositions may be placed on the structure so as to be at least partially offset when the structure is observed from one or other of the faces of the structure, and this whether the illuminant is placed on the side of one or the other of the faces, that is to say during an observation in reflected or transmitted light. The first and second compositions may be at least partially superposed, when the structure is observed from one or the other of the faces of the structure, and this whether the illuminant is placed on the side of one or the other of the faces, that is to say during an observation in reflected or transmitted light.

In one exemplary embodiment, one of the first and second compositions forms a flat tint area which is superposed on the other of the first and second compositions, the other of the first and second compositions forming at least one pattern.

The flat tint area may cover all or part of the structure. The flat tint area is for example defined by the fluorescent composition while the second phosphorescent composition defines the pattern. In one variant, the flat tint area is defined by the phosphorescent composition while the fluorescent composition defines the pattern.

In one exemplary embodiment, one of first and second compositions forms at least one pattern which, on extinguishing the lighting by the predefined illuminant, appears or disappears, or which changes appearance while passing from a positive pattern to a negative pattern or from one color to another.

Thus, the contrast of the pattern with respect to its immediate background can be modified between the state where the first and second compositions are lit by the predefined illuminant and one where they are no longer lit by it, the modification of the contrast resulting for example from a change of color of the pattern and/or of its immediate background, or of light intensity of the pattern and of its immediate background.

The first and second compositions may be deposited by printing or by deposition of a lacquer, one covering for example the other completely or one being placed next to the other without covering it. One may also be placed with partial superposition only on the other.

The first and second compositions may emit by luminescence one and same color, with substantially the same intensity or with different intensities.

When the first and second compositions emit the same color with substantially the same intensity, it may be advantageous to form, with one of the compositions, a flat tint area and to deposit the other composition in the form of at least one pattern. In the case of an at least partial superposition of the first and second compositions with the pattern that is defined by the phosphorescent composition and the flat tint area by the fluorescent composition, when the structure is illuminated under the predefined illuminant, the pattern cannot be observed in the zones of superposition of the compositions because the light emitted by the flat tint area masks the pattern, whereas when the illumination ceases, the light emitted by the phosphorescent composition makes it possible to observe the pattern, either in positive writing if the phosphorescent composition is deposited in the form of printing in positive writing, or in negative writing if the phosphorescent composition is deposited in the form of printing in negative writing.

The expression "substantially of the same intensity" should be understood to mean that the difference in luminosity is not detectable with the naked eye.

In one variant, the phosphorescent and fluorescent compositions emit by luminescence the same color but at different intensities. In this case, under the predefined illuminant, a positive pattern can be revealed and this pattern changes to a negative pattern after extinguishing the illuminant, this is the case for example if the fluorescent composition is form a pattern and is of greater intensity than the phosphorescent composition which surrounds the pattern, or conversely the pattern appears as a negative pattern under the illuminant then as a positive pattern after extinguishing the illuminant.

Preferably, the phosphorescent composition is located on top of the fluorescent composition.

It is understood that the change in appearance of a pattern from positive to negative, or vice versa, means that the pattern is still discernable but that its inner color or intensity is modified with respect to the background, that is to say with respect to the color or the intensity which surrounds the pattern.

The phosphorescent and luminescent compositions may also emit, by luminescence, different colors. In this case, it may be advantageous for the compositions to be at least partially superposed. Under lighting with the predefined illuminant, it is then possible to observe, in a zone of superposition of the first and second compositions, a visible light of a third color, which results from the additive synthesis of the lights emitted by luminescence respectively by the phosphorescent composition and by the fluorescent composition. It may also be advantageous for, on certain zones at least, the compositions not to be superimposed, so as to make it possible to observe their own colors.

The first and second compositions may be applied in register on the security structure, in particular when they are juxtaposed. The first composition may form at least one positive pattern and the second composition at least one negative pattern, preferably complementary to the positive pattern, placed in register. The placing in register of the compositions may be carried out on one and the same face of a support of the structure or on both sides of the support, which is then at least partially transparent.

As mentioned above, the first and second compositions may be juxtaposed and are not superposed, especially in the case of printing in register.

The security structure may comprise an apertured opaque layer and the first and second compositions may be located respectively on the first and second side of this layer. The apertured opaque layer may be defined for example by at least one layer of metal that is locally demetallized or by a selective metallization or by an opacifying printing which is not necessarily metallic, for example comprising a black pigment or $TiO_2$.

The presence of the apertured opaque layer may enable, in the aperture(s), the light emitted by the second composition to be added at partially to the light emitted by the first composition, and therefore the observation, under the predefined illuminant, of a resulting light that is a function of the luminescence colors present. Furthermore, the apertures of the apertured opaque layer may also form patterns, which further reinforces the security of the structure.

In one exemplary embodiment, the security structure comprises an apertured opaque layer, with on one side of this layer, the first and second respectively fluorescent and phosphorescent compositions and, on the other side of this apertured opaque layer, at least one other phosphorescent or fluorescent luminescent composition, preferably third and fourth respectively fluorescent and phosphorescent compositions.

Many arrangements of the first, second, third and fourth compositions are possible, in order in particular to adjust the nature of the compositions that are superposed across the apertures of the apertured opaque layer.

In particular, in one exemplary embodiment, the first and third compositions are offset when the structure is observed from the first face. The second composition is also offset with respect to the fourth. The first and third compositions may be at least partially superposed with an aperture. The same may be true of the second and fourth compositions. The first and fourth compositions may be superposed at an aperture. The same may be true of the second and third compositions. The first and second compositions may be juxtaposed, without being superpose; the same is for example true of the third and fourth compositions.

The first and third compositions may be identical or different, in the same way as the second and fourth compositions. When the first and third compositions are different, and also the second and fourth compositions, the first composition may emit by luminescence, in one example, the color of the fourth and the second composition that of the third.

In one exemplary embodiment, the structure comprises two apertured opaque layers, it being possible for these opaque layers to be apertured differently. The first composition may be located between the two apertured opaque layers and one of the apertured opaque layers may be located between the two compositions. Furthermore, the apertures of the apertured opaque layer may also form patterns, which also reinforces the security of the structure.

Alternatively or in combination with an apertured opaque layer, the security structure may comprise at least one element that serves as a barrier to ultraviolet (UV) radiation, in particular a layer that serves as a barrier to UV radiation. Such a barrier layer may for example be applied by printing and/or by coating. The barrier layer may be applied partially or completely to the support and/or to the fluorescent composition and/or to the phosphorescent composition.

The term "barrier" is understood to mean that the element or layer prevents the passage of UV radiation for at least a certain range of wavelength values. The "barrier" function may make it possible to avoid the effects of subtractive combination of fluorescence and phosphorescence.

The barrier layer may for example be applied by a conventional printing process, for example flexography, screen printing, inkjet or digital printing, by curtain coating, by roller coating, by spraying or painting, inter alia.

The barrier element and/or layer may be applied in the form of a pattern, for example a symbol, an alphanumerical character, a logo, inter alia. The pattern may be reproduced in an identical manner on the security document comprising the security structure.

The support for the security structure may incorporate at least one barrier element to UV radiation and/or at least one barrier layer to UV radiation may be applied to at least one of the faces of the support and/or to at least one of the fluorescent and phosphorescent compositions. In particular, a first barrier layer to UV radiation may be applied to the fluorescent composition and a second barrier layer to UV radiation may be applied to the phosphorescent composition, the first and second layers comprising, in particular, barrier elements to UV radiation which are not superposed.

The barrier layer and/or element to UV radiation may make it possible to prevent the passage of UV radiation, the wavelength of which is less than or equal to 400 nm.

The barrier layer and/or element may comprise a binder chosen as a function of the support, for example nitrocellulose, PVC, acrylate, inter alia. The barrier layer and/or element may comprise an additive that absorbs UV radiation, for example a phosphite, triazine, benzotriazole, an ether amine, for example Tinuvin® sold by CIBA or Chisorb® sold by DOUBLE BOND, inter alia.

At least one of the compositions may be introduced into the security structure other than by printing. For example, at least one of the layers of the security structure is an extruded thermoplastic film or a coating, which incorporates a fluorescent or phosphorescent pigment or dye, or even which is constituted of a fluorescent or phosphorescent compound.

The term "composition" should thus largely be understood as encompassing both a solid film and a deposition that has solidified, such as a deposition of ink for example or a lacquer.

The fluorescent composition and/or the phosphorescent composition may comprise a mixture of iridescent substances that exhibit an interference effect.

Among the iridescent substances that can be used according to the invention, mention may especially be made of mother-of-pearl extracts, lead salts and micas. As such, the preferred substances are micas, because the mother-of-pearl extracts are very expensive, and the lead salts involve, due to their toxicity, adhering to very strict health and safety rules. Among the iridescent substances that are suitable, micas coated with at least one metal oxide are recommended, and in particular the product sold by the company Merck AG under the name IRIODINE®, these products being micas coated with $TiO_2$ with, where appropriate, at least one other metal oxide.

The security structure may be in the form of a security element intended to be integrated into any security document, in particular a paper document comprising natural and/or synthetic fibers, in particular cellulose fibers.

The security structure may advantageously be in the form of a security thread or a patch or a security film. Alternatively, the security structure may be one and the same with the security document, when the latter comprises a substrate on which the first and second compositions are applied directly, for example by printing, on the substrate of the document in its entirety or as a strip. In the case of a security structure in thread form, the latter may be integrated into a paper mass during the formation of the sheet, for example in a cylinder machine or a Fourdrinier machine. In this case, the sheet may be formed so as to be equipped with windows, constituting apertures that at least partially reveal the security thread or the patch.

Another subject of the invention is a security document incorporating a security structure as defined previously.

The security structure may be observable from the two faces of the document or from only one of the faces, depending on the variants. The security structure may optionally be one and the same with the document, for example when the latter comprises a paper or other substrate that is printed with the first and second compositions.

The security document may be chosen from identity documents and documents of value, for example banknotes, tickets to shows or sporting events, checks, identity cards, passports, transport documents, inter alia.

Preferably, each of the fluorescent and phosphorescent compositions extends over less than the total area of one face of the document.

The fluorescent composition preferably emits a red, green, blue or yellow color under a UV illuminant at 365 nm. The same is true for the phosphorescent composition.

The security document, or the security structure that it comprises, may comprise one or more supplementary security elements as defined below.

Among the supplementary security elements, some can be detected by eye, in daylight or in artificial light, without the use of a particular apparatus. These security elements comprise, for example, colored fibers or flakes, and threads that are completely or partially printed or metalized. These security elements are referred to as first-level security elements.

Other types of supplementary security elements are detectable only with the aid of a relatively simple apparatus, such as a lamp that emits in the ultraviolet (UV) or the infrared (IR) range. These security elements comprise, for example, fibers, flakes, strips, threads or particles. These security elements may be visible to the naked eye or not, for example being luminescent under lighting by a Wood's lamp emitting in a wavelength of 365 nm. These security elements are referred to as second-level security elements.

Other supplementary security elements require, for their detection, a more sophisticated detection apparatus. These security elements are, for example, capable of generating a specific signal when they are subjected, simultaneously or not, to one or more external excitation sources. The automatic detection of the signal makes it possible to authenticate, where appropriate, the document. These security elements comprise, for example, markers that are in the form of active materials, particles or fibers, capable of generating a specific signal when these markers are subjected to an optoelectronic, electric, magnetic or electromagnetic excitation. These security elements are referred to as third-level security elements.

The supplementary security element(s) present within the security document, or the security structure that it comprises, may have first-, second- or third-level security features.

The phosphorescent composition may contain at least one phosphorescent compound chosen from zinc sulfide DOPED ZN S and a mixture of inorganic salts, for example produced by the company GLOWBUG.

The fluorescent composition may contain at least one fluorescent compound chosen from a styrene-acrylic copolymer from the company ARJOWIGGINS and a zinc sulfide-doped magnesium from the company GLOWBUG.

Another subject of the invention is a process for manufacturing a security structure as defined above, in which first and second compositions, which are respectively fluorescent and phosphorescent, especially under UV illuminant at 365 nm, are deposited on a support, the deposition taking place so that the two compositions can be excited simultaneously from one and the same face of the structure. The deposition of the compositions may take place by printing, especially registered printing of one of the compositions with respect to the other. The compositions may be deposited on a single face of the structure or, as a variant, on both faces of the structure. The phosphorescent and fluorescent compositions each have, for example, a thickness between 1 and 6 μm.

Another subject of the invention is a process for manufacturing a security document in which a security structure according to the invention, as defined above, is integrated into a paper substrate.

Another subject of the invention is a process for authenticating a document comprising a security structure as defined above, one of the first and second compositions of the security structure of the document forming at least one pattern, the process comprising the following steps:

the document is lit with the predefined illuminant, the authenticity of the document is verified by means of the pattern which, on extinguishing the lighting by the predefined illuminant, appears or disappears, or which changes appearance while passing from a positive or negative pattern or from one color to another.

In one exemplary embodiment, one face of the structure is observed under UV illuminant and after extinguishing the UV illuminant, and from the comparison of the observations, information relating to the authenticity of the document is deduced. This comparison may be carried out automatically within a machine tasked with this comparison, where appropriate. In particular, under UV illuminant, the light emitted by the fluorescent composition and the light emitted by the phosphorescent composition and/or an additive combination of the latter are simultaneously observed. After extinguishing the UV illuminant, only the light emitted by the phosphorescent composition can be observed. According to the combinations described above, it is thus possible to make patterns formed by the first and/or second compositions appear/disappear, which, by a comparison between the presence of UV illuminant and after it has been extinguished, makes it possible to authenticate the document.

Figure 2:
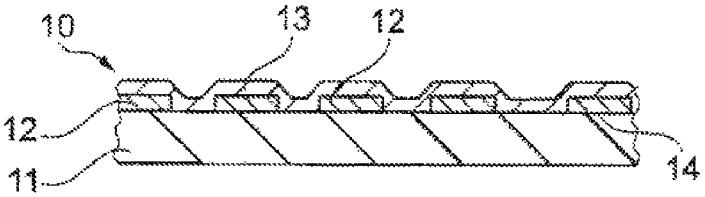
Figure 3A:
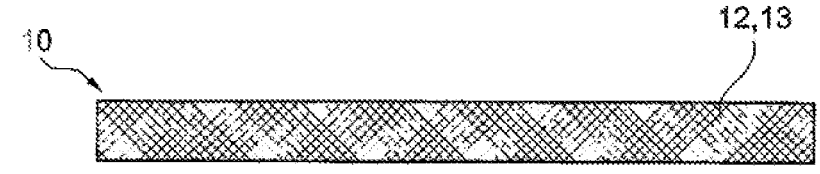
Figure 3B:
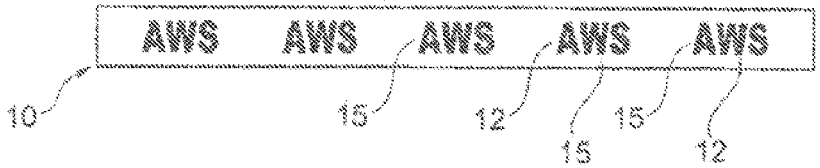
Figure 4A:
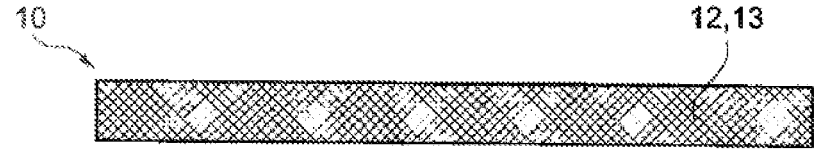
Figure 4B:
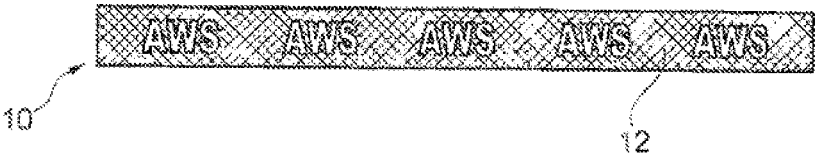
Figure 3C:
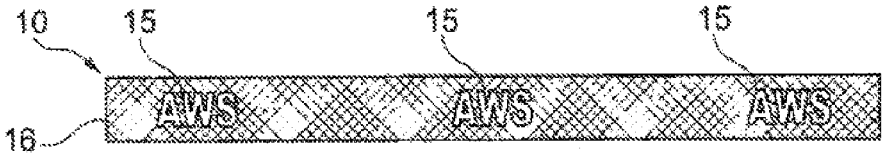
Figure 3D:
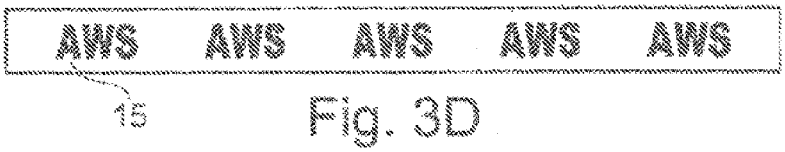
Figure 11:
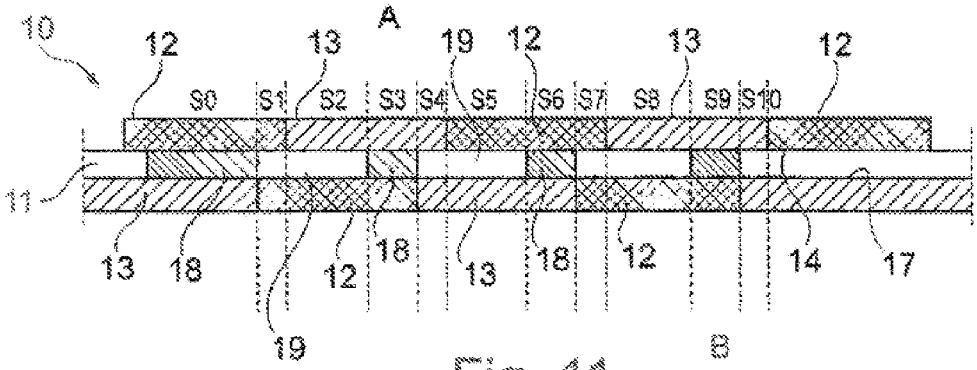
Figure 12:
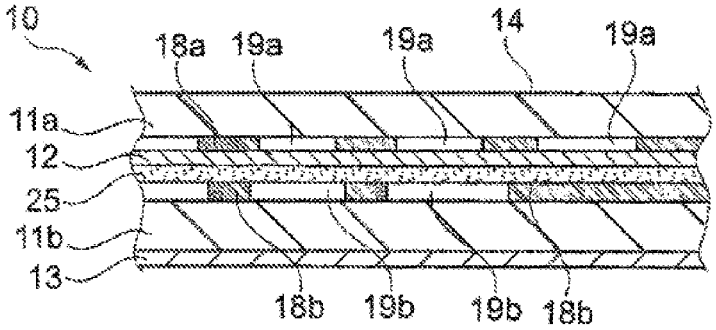
Figure 13:
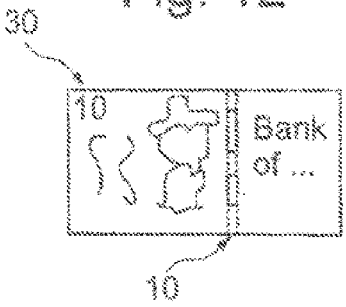
Figure 14:
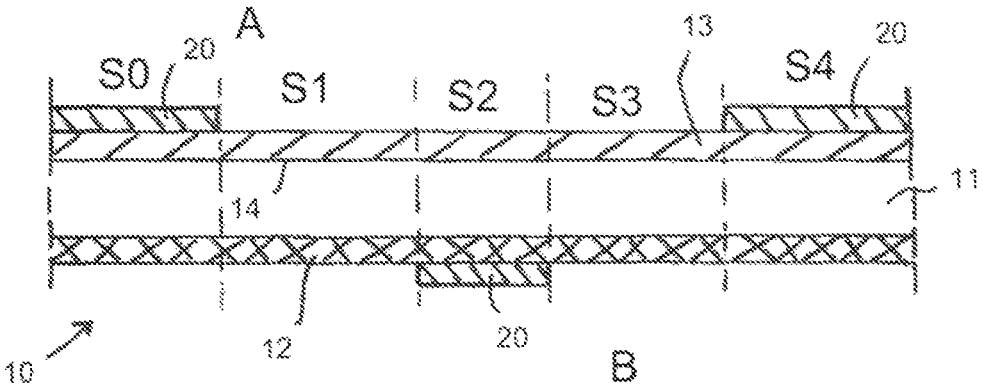

The invention will be better understood on reading the detailed description which follows, of non-limiting exemplary embodiments thereof, and examining the appended drawings, in which:

FIG. 1 represents, in isolation, schematically and partially, as a front view, an example of a security structure according to the invention, FIG. 2 is a partial and schematic longitudinal section of the security structure, FIGS. 3*a* and 3*b* represent the structure from FIG. 1, respectively when observed under UV and when the UV illumination ceases, FIGS. 3*c* and 3*d* are views similar to FIGS. 3*a* and 3*b*, of an embodiment variant, FIGS. 4*a* and 4*b* are views similar to FIGS. 3*a* and 3*b*, of another embodiment variant, FIGS. 5 to 12 are views similar to FIG. 2, of embodiment variants, FIG. 13 represents an example of a security document incorporating a security structure according to the invention, and FIG. 14 is a view similar to FIG. 2, of an embodiment variant.

Represented in FIG. 1 is an example of a security structure 10, produced in accordance with the invention.

In the example from FIG. 1, the security structure 10 is in the form of a security thread, the width l of which is for example between 0.5 mm and 25 mm, this thread being intended, for example, to be incorporated as a strip in a security document, extending then from one edge of this document to the opposite edge, it being possible for the incorporation to be carried out as window(s) or at the surface.

The thickness of the structure 10 is generally, for example, between 12 and 45 μm.

The invention is not limited to a security structure in thread form and what follows applies to any security structure that is in a form other than a thread, for example as a patch or foil, or even to a security structure constituted by the document itself.

The structure 10 comprises a support 11 which has, for example, a single-layer or multilayer structure, the support 11 preferably comprising at least one layer of a thermoplastic material which is preferably transparent, for example of PET.

The structure 10 may comprise thermo-adhesive lacquers or other surface coatings intended to improve its attachment to the substrate, especially fibrous substrate, to which or on which it is fastened. The structure 10 may comprise additional security elements, such as magnetic or other elements, chosen from those of the aforementioned first, second or third levels.

The support 11 bears on a face 14 a phosphorescent composition 12 covered by a fluorescent composition 13.

The phosphorescent composition 12 is for example deposited by printing onto the support 11 and forms one or more patterns 15, for example in positive writing as can be seen in FIG. 3*b*.

The fluorescent composition 13 is for example deposited in the form of a flat tint area which covers the whole of the face 14 of the support 11 and the patterns 15 defined by the phosphorescent composition 12. The fluorescent composition 13 is for example deposited by printing.

The phosphorescent composition 12 and fluorescent composition 13 may be chosen so as to emit by luminescence under UV excitation, at 365 nm, one and the same color substantially at the same intensity, so that, under UV lighting, the structure 10 appears from the side of the face 14 of the support to have a substantially uniform appearance, as illustrated in FIG. 3*a*, with no possibility for the observer to discern the patterns 15 formed with the phosphorescent composition 12.

After extinguishing the UV illuminant, the layer of fluorescent composition 13 stops emitting and the patterns 15 defined by the phosphorescent composition 12 are seen to appear, as illustrated in FIG. 3*b*. The duration for which the patterns 15 formed with the composition 12 remain visible depends on the afterglow time of the phosphorescent composition. Preferably, this afterglow time is greater than or equal to 3 seconds.

It is also possible to use phosphorescent compositions 12 and fluorescent compositions 13 which emit, by luminescence, different colors. In this case, under UV lighting at 365 nm, the two compositions 12 and 13 emit different lights which, by additive synthesis where the compositions are superposed, give patterns 15 which appear as a first color, on a colored background 16 which appears as another color, which is that of the fluorescence of the fluorescent composition 13 in the example illustrated in FIG. 3*c*.

For example, during the use of a fluorescent composition 13 which emits, by fluorescence, blue light and of a phosphorescent composition 12 which emits, by phosphorescence, yellow light, under UV lighting the patterns 15 appear white, by additive synthesis where the compositions are superposed, whereas the background 16 appears blue. When the UV excitation is extinguished, the patterns 15 appear yellow for the afterglow time of the phosphorescent composition 12, as illustrated in FIG. 3*d*.

In the example from FIGS. 3*a* and 3*b*, the printing produced with the phosphorescent composition 12 is printing in positive writing.

It is possible, without departing from the scope of the present invention, to carry out this printing in negative writing, as illustrated in FIGS. 4*a* and 4*b*. The term "writing"

should not be understood with a limiting meaning and encompasses images and drawings in addition to standard script characters. Under UV excitation, the security structure 10 appears as a uniform color in the case of the use of phosphorescent and fluorescent compositions that emit, by luminescence, substantially the same color with the same intensity. In FIG. 4*b*, it is seen that, after extinguishing the UV source, the negative writing defined by the phosphorescent composition 12 appears.

It is also possible to use phosphorescent and fluorescent compositions which emit the same color, but at different intensities. In this case, under UV and by assuming that the phosphorescent composition defines positive patterns, the pattern or patterns will appear with a different contrast relative to the background compared with the absence of UV, due to the addition of the light intensities of the phosphorescent composition and of the fluorescent composition. After extinguishing the UV source, only the patterns defined by the phosphorescent composition appear as positive patterns.

In one variant, a pattern defined by the phosphorescent composition is superposed on a flat tint area of fluorescent composition, the phosphorescent composition emitting with a lesser intensity than the fluorescent composition.

Figure 5:
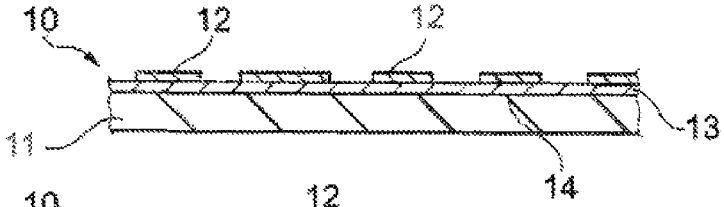

In the embodiment variant from FIG. 5, the fluorescent composition 13 is deposited in the form of a flat tint area on the face 14 of the support 11, while the phosphorescent composition 12 is deposited in the forms of patterns in positive or negative writing, depending on the variants. The expression "flat tint area" should be understood to mean a homogenous deposition of sufficient area to extend around the pattern at least.

Figure 6:
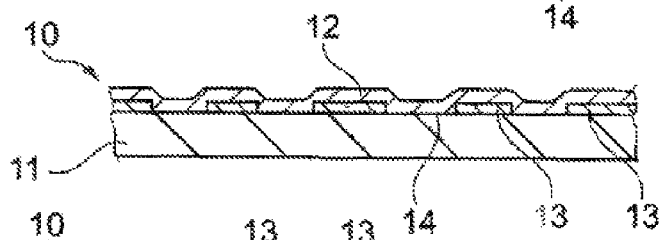

In the embodiment variant from FIG. 6, the fluorescent composition 13 is deposited on the face 14 of the support 11 in the form of patterns, in positive or negative writing, and the phosphorescent composition 12 is deposited in the form of a flat tint area which covers the fluorescent composition 13.

Figure 7:
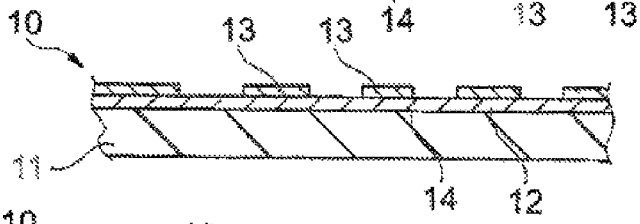

In the example from FIG. 7, the phosphorescent composition 12 is deposited in the form of a flat tint area on the face 14 of the support 11, while the fluorescent composition 13 is deposited so as to define patterns, in positive or negative writing, on the phosphorescent composition 12.

In the above examples described with reference to FIGS. 2 and 5 to 7, the phosphorescent compositions 12 and fluorescent compositions 13 are located on one and the same side of the support 11.

Figure 8:
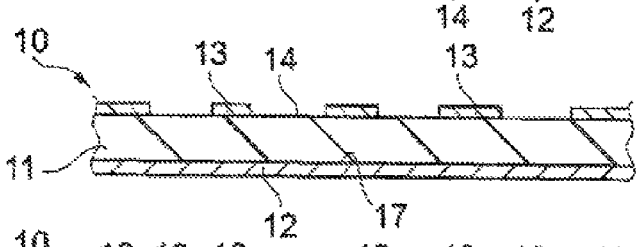

It is possible, without departing from the scope of the present invention, to place the phosphorescent composition 12 and fluorescent composition 13 respectively on the first and second side of the support 11, the fluorescent composition 13 being, for example, deposited on the face 14 and the phosphorescent composition 12 on the opposite face 17, as illustrated in FIG. 8, the support 11 being at least partially transparent where the compositions 12 and 13 are superposed and/or where it is superposed with the composition deposited on the face 17.

Figure 9:
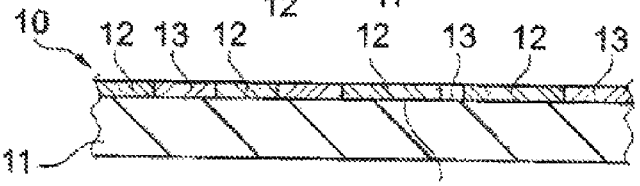

In FIG. 9, an embodiment variant has been illustrated in which the phosphorescent composition 12 and fluorescent composition 13 are positioned in a juxtaposed and registered manner on one and the same side of the support 11. In this exemplary embodiment, there is no superposition of the compositions 12 and 13.

Figure 10:
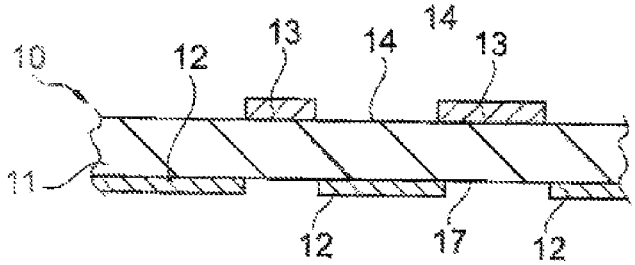

In the embodiment variant from FIG. 10, the compositions 12 and 13 are deposited respectively on the first and second side of the support 11, the face 14 of the support 11 being, for example, printed with the fluorescent composition 13 and the opposite face 17 with the phosphorescent composition 12. This printing may take place in register, as illustrated.

In the variants from FIGS. 8 and 10, the support 11 is at least partially transparent, so as to make it possible to excite the luminescence starting from an illumination of the structure 10 from one and the same side thereof, and to observe from this same side the light emitted by luminescence both by the fluorescent composition 13 and by the phosphorescent composition 12.

The support 11 may be only partially transparent, possibly comprising opaque zones 18, for example metallizations, and apertures 19, as illustrated in FIG. 11.

The compositions 12 and 13 may be printed in register on each of the faces of the support 11, so that on each of the faces of the structure it is possible to observe a juxtaposition of zones formed respectively by the phosphorescent composition 12 and by the fluorescent composition 13. Zones are thus observed where the compositions 12 or 13 located on either side of the support 11 are both superposed at least partially with one and the same opaque zone 18 of the support 11, which is the case for zones S0, S3, S6, S9 in FIG. 11, and zones where the phosphorescent compositions 13 respectively located on the first and second side of the support 11 are superposed with apertures 19, which is the case for zones S1, S7. Zones are also observed where the fluorescent compositions 13 respectively located on the first and second side of the support 11 are superposed with apertures 19, which is the case for zones S4 and S10. Zones are also observed where the fluorescent composition 12 and phosphorescent composition 13 respectively located on the first and second side of the support 11 are superposed, which is the case for zones S2, S5 and S8.

Depending on the nature of the fluorescent and phosphorescent compositions, it is possible to observe various effects. Distinguished below are two sides A and B of illumination of the structure and of observation thereof, the side A being turned toward the face 14 of the support 11 and the side B being on the opposite side.

EXAMPLE 1

Lighting Under UV Maintained with the Phosphorescent Composition 12 which Emits a Blue Light and the Fluorescent Composition 13 a Yellow Light

| | | Visual appearance | | | | | | | | | | |
|---|---|---|---|---|---|---|---|---|---|---|---|---|
| Observer | UV lighting | So | S1 | S2 | S3 | S4 | S5 | S6 | S7 | S8 | S9 | S10 |
| A | A | blue | blue | yellow | yellow | yellow | blue | blue | blue | yellow | yellow | yellow |
| B | B | yellow | blue | blue | blue | yellow | yellow | yellow | blue | blue | blue | yellow |
| A | B | zero | blue | violet | zero | yellow | white | zero | blue | violet | zero | yellow |
| B | A | zero | blue | white | zero | yellow | violet | zero | blue | white | zero | yellow |

When the lighting is maintained on the side of face B, which is observed from face A, violet is seen level with zone S2, which corresponds to the emission of blue light under the fluorescent composition which emits in the yellow range.

When the lighting is maintained on the side of face A, which is observed from face B, white is seen level with zone S8, which corresponds to the emission of yellow light under the layer of phosphorescent composition which emits in the blue range.

EXAMPLE 2

After Extinguishing the UV Lighting with the Phosphorescent Composition 12 which Emits in the Yellow Range and the Fluorescent Composition 13 in the Blue Range

| | After extinguishing | Visual appearance | | | | | | | | | | |
|---|---|---|---|---|---|---|---|---|---|---|---|---|
| Observer | UV lighting | So | S1 | S2 | S3 | S4 | S5 | S6 | S7 | S8 | S9 | S10 |
| A | A | zero | zero | yellow | yellow | yellow | zero | zero | zero | yellow | yellow | yellow |
| B | B | yellow | zero | zero | zero | yellow | yellow | yellow | zero | zero | zero | yellow |
| A | B | zero | zero | yellow | zero | intense yellow | yellow | zero | zero | yellow | zero | intense yellow |
| B | A | zero | zero | yellow | zero | intense yellow | yellow | zero | zero | yellow | zero | intense yellow |

EXAMPLE 3

After Extinguishing the UV Lighting with, from the Side of Face A, the Phosphorescent Composition Emits in the Yellow Range and the Fluorescent Composition Emits in the Blue Range and, from the Side of Face B, the Phosphorescent Composition Emits in the Blue Range and the Fluorescent Composition Emits in the Yellow Range

| | After extinguishing | Visual appearance | | | | | | | | | | |
|---|---|---|---|---|---|---|---|---|---|---|---|---|
| Observer | UV lighting | So | S1 | S2 | S3 | S4 | S5 | S6 | S7 | S8 | S9 | S10 |
| A | A | zero | zero | yellow | yellow | yellow | zero | zero | zero | yellow | yellow | yellow |
| B | B | zero | blue | blue | blue | zero | zero | zero | blue | blue | blue | zero |
| A | B | zero | blue | violet | zero | yellow | zero | zero | blue | violet | zero | yellow |
| B | A | zero | blue | white | zero | yellow | zero | zero | blue | white | zero | yellow |

FIG. 14 represents another embodiment variant of a security structure 10 according to the invention.

In this example, the support 11 is completely transparent and comprises, on each of its opposite faces, elements 20 that act as a barrier to ultraviolet (UV) radiation, applied for example in the form of layers respectively on the fluorescent composition 13 and on the phosphorescent composition 12. In particular, the barrier elements 20 may be placed on either side of the support 11 without being superposed on one another.

Preferably, the elements 20 that act as a barrier to ultraviolet radiation are transparent to visible radiation so that the pattern that they form is visible only under a predefined excitation and invisible under visible radiation, which further adds to the security of the structure.

The barrier elements 20 may correspond to printings and/or coatings produced on the support 11.

The barrier elements 20 may form a pattern, which may appear under a predefined excitation in order to enable the authentication of the security structure 10.

The formation of the barrier elements 20 on the support 11, especially by printing and/or coating, may be carried out after the manufacture of the support 11 coated with the fluorescent composition 13 and phosphorescent composition 12, thus making it possible to personalize the security structure 10, for example in the form of a security thread, with the aid of the barrier elements 20 positioned in the form of patterns.

The barrier elements 20 may be printed in register on each of the faces of the support 11, which are respectively coated with the fluorescent composition 13 and with the phosphorescent composition 12. Zones are thus observed where the compositions 12 and 13 located on either side of the support 11 are superposed on one another, which is the case for zones S1 and S3, and zones where the compositions 12 and 13 located on either side of the support 11 are both at least partially superposed with one and the same barrier element 20, which is the case for zones S0, S2 and S4.

Depending on the nature of the fluorescent and phosphorescent compositions, it is possible to observe various effects. Distinguished below are two sides A and B of illumination of the structure and of observation thereof, the side A being turned toward the face 14 of the support 11 and the side B being on the opposite side.

EXAMPLE 4

Lighting Under UV Maintained with the Phosphorescent Composition 12 which Emits a Blue Light and the Fluorescent Composition 13 a Yellow Light

| | | Visual appearance | | | | |
|---|---|---|---|---|---|---|
| Observer | UV lighting | S0 | S1 | S2 | S3 | S4 |
| A | A | zero | yellow | yellow | yellow | zero |
| B | B | blue | white | zero | white | blue |
| A | B | zero | white | zero | white | zero |
| B | A | zero | blue | zero | blue | zero |

When the lighting is maintained on the side of face A which is observed from face B, or when the lighting is maintained on the side of face B which is observed from face A, white is seen level with zones S1 and S3, which corresponds to an emission of yellow (or blue) light under the layer of phosphorescent (or fluorescent) composition which emits in the blue (or yellow) range.

The embodiments described previously may be combined with one another. In particular, the support 11 from FIG. 14 may comprise opaque zones, as described previously, for example in the form of metallizations, and/or barrier elements to UV radiation placed for example between apertures 19 as described previously.

In particular, a support 11 comprising barrier elements 20 may be produced using two films, especially made of polyester, the first film acting as a support for the printing and/or the coating of barrier elements 20, which constitute a second film on which the fluorescent and/or phosphorescent compositions are deposited.

As a variant, provision is made according to the invention for the security structure to comprise only one first fluorescent composition and one second phosphorescent composition in the form of a flat tint area which are positioned respectively on the first and second side of the apertured support.

Represented in FIG. 12 is an embodiment variant in which the structure 10 comprises two transparent layers 11*a* and 11*b*.

Deposited on each transparent layer 11*a* and 11*b* is a partially opaque layer 18*a*, 19*a* and 18*b* and 19*b*. An adhesive 25 ensures the cohesion of the layers 11*a*, 11*b* and of the apertured opaque layers.

When the structure 10 is observed under UV illuminant from the face 14 of the layer 11*a*, by lighting the structure from this face, the lights emitted, by luminescence, by the compositions 12 and 13 add together where the apertures 19*b* enable the light emitted by the fluorescent composition 13 to reach the face 14, while where this light is blocked by the opaque zones 18*b*, the patterns formed by the apertures 19*a* can only be observed with the light produced by the fluorescent composition 13.

Represented in FIG. 13 is an example of a security document 30 incorporating a security structure 10 in accordance with the invention. The latter is in the form of a security thread incorporated in windows, and extending from one edge to the other of the document.

Of course, the invention is not limited to the exemplary embodiments which have just been described. It is possible, in particular, to combine together the distinctive embodiment features of the examples which have just been described within variants that are not illustrated.

The expression "comprising a" should be understood as being synonymous with "comprising at least one", unless otherwise specified.

The invention claimed is:

1. A security structure comprising:

at least one first fluorescent composition, at least one second phosphorescent composition, the first and second compositions being able to be excited simultaneously by a predefined illuminant from one and the same first face of the structure, the first fluorescent and second phosphorescent compositions being deposited on a support of the security structure, the support having first and second sides the security structure being in the form of a security thread, a security film or a patch, and the first fluorescent composition being superposed, at least partially, with the second phosphorescent composition and/or the first and second compositions being applied in register on the security structure, and the security structure comprising, on each of the first and second sides of the support, a barrier layer applied partially to the support of the security structure and/or to the first fluorescent composition and/or second phosphorescent composition, the first fluorescent and second phosphorescent composition being situated between the barrier layers in the thickness direction of the security structure, the barrier layers having a property of acting as a barrier to ultraviolet radiation if exposed thereto, the barrier layers being transparent to visible radiation, the barrier layers comprising an additive that absorbs UV radiation chosen from a phosphite, a triazine, a benzotriazole and an ether amine.

2. The security structure as claimed in claim 1, wherein lights emitted, under lighting by the predefined illuminant, by the fluorescent composition and by the phosphorescent composition can be observed from one and the same face of the structure.

3. The security structure as claimed in claim 2, the first and second compositions emitting by luminescence one and the same color.

4. The security structure as claimed in claim 3, the first and second compositions emitting by luminescence one and the same color with substantially the same intensity.

5. The security structure as claimed in claim 3, the first and second compositions emitting by luminescence one and the same color with different intensities.

6. The security structure as claimed in claim 5, the phosphorescent composition being on top of the fluorescent composition.

7. The security structure as claimed in claim 1, one of the first and second compositions forming a flat tint area which is superposed on the other of the first and second compositions, the other of the first and second compositions forming at least one pattern.

8. The security structure as claimed in claim 1, wherein one of the first and second compositions forms at least one pattern which, on extinguishing the lighting by the predefined illuminant, appears or disappears, or which changes appearance while passing from a positive pattern to a negative pattern or from one color to another.

9. The security structure as claimed in claim 1, the first and second compositions being deposited by printing or by deposition of a lacquer.

10. The security structure as claimed in claim 1, the first fluorescent composition emitting, under lighting by the predefined illuminant, a visible light of a first color, the second phosphorescent composition emitting, under lighting by the predefined illuminant, a visible light of a second color that is different than the first color, and at least one zone of superposition of the first and second fluorescent and phosphorescent compositions emitting, under lighting by the predefined illuminant, a visible light of a third color resulting from the additive synthesis of the first and second colors.

11. The security structure as claimed in claim 1, the first composition being juxtaposed with the second composition.

12. The security structure as claimed in claim 1, a support of the security structure incorporating at least one barrier element.

13. The security structure as claimed in claim 1, the barrier layer comprising a binder chosen from nitrocellulose, PVC and acrylate.

14. The security structure as claimed in claim 1, the first fluorescent and second phosphorescent compositions being deposited on one and the other side of the support, the barrier layers being applied respectively on the first fluorescent and second phosphorescent compositions.

15. A security structure comprising:

at least one first fluorescent composition, at least one second phosphorescent composition, the first and second compositions being able to be excited simultaneously by a predefined illuminant from one and the same first face of the structure, the security structure being in the form of a security thread, a security film or a patch, the first fluorescent composition being superposed, at least partially, with the second phosphorescent composition and/or the first and second compositions being applied in register on the security structure, and the security structure further comprising an apertured opaque layer having a first side and a second side, and the first and second compositions being located respectively on the first side and second side of the apertured opaque layer.

16. The security structure as claimed in claim 15, the structure comprising a first apertured opaque layer and a second apertured opaque layer, the first apertured opaque layer being apertured differently than the second aperture opaque layer.

17. A security structure comprising:

at least one first fluorescent composition, at least one second phosphorescent composition, the first and second compositions being able to be excited simultaneously by a predefined illuminant from one and the same first face of the structure, the security structure being in the form of a security thread, a security film or a patch, the first fluorescent composition being superposed, at least partially, with the second phosphorescent composition and/or the first and second compositions being applied in register on the security structure, and the security structure comprising two apertured opaque layers, the second composition being located between the two apertured opaque layers and one of the apertured opaque layers being located between the first composition and the second composition.

18. A security structure comprising:

at least one first fluorescent composition, at least one second phosphorescent composition, the first and second compositions being able to be excited simultaneously by a predefined illuminant from one and the same first face of the structure, the security structure being in the form of a security thread, a security film or a patch, the first fluorescent composition being superposed, at least partially, with the second phosphorescent composition and/or the first and second compositions being applied in register on the security structure, and the security structure further comprising an apertured opaque layer having a first side and a second side, the first side of the apertured opaque layer comprising the first fluorescent composition and the second phosphorescent composition, the second side of the apertured opaque layer comprising a third fluorescent composition or fourth phosphorescent composition, at least one aperture of the aperture opaque layer comprising a superposition of one composition chosen from one of the first and second compositions and one composition chosen from one of the third and fourth compositions.

19. The security structure as claimed in claim 18, the first and third compositions being offset when the structure is observed from the first face (14).

20. A security document incorporating a security structure as claimed in claim 1.

21. A security document incorporating a security structure comprising:

at least one first fluorescent composition, at least one second phosphorescent composition, the first and second compositions being able to be excited simultaneously by a predefined illuminant from one and the same first face of the structure, the security document comprising a paper substrate on which the first and second compositions are applied directly, and the first fluorescent composition being superposed, at least partially, with the second phosphorescent composition, and/or the first and second compositions being applied in register on the security structure, and the security structure comprising, on each side of the paper substrate, a barrier layer having a property of acting as a barrier to ultraviolet radiation if exposed thereto, the first fluorescent and second phosphorescent compositions being situated between the barrier layers in the thickness direction of the security structure, the barrier layers being transparent to visible radiation, the barrier layers being applied in the form of a pattern, the barrier layers comprising an additive that absorbs UV radiation chosen from a phosphite, a triazine, a benzotriazole and an ether amine.

22. A process for authenticating a security document as claimed in claim 21, one of the first and second compositions of the security structure of the document forming at least one pattern, the process comprising the following steps:

lighting the document with the predefined illuminant, verifying the authenticity of the document by using the pattern which, on extinguishing the lighting by the predefined illuminant, appears or disappears, or which changes appearance while passing from a positive pattern to a negative pattern or from one color to another.

* * * * *